US008887950B2

(12) United States Patent
Salciarini et al.

(10) Patent No.: US 8,887,950 B2
(45) Date of Patent: Nov. 18, 2014

(54) CASE FOR COSMETIC OR BODY HYGIENE PRODUCT HAVING A RETRACTABLE HINGE

(75) Inventors: Christian Salciarini, Couilly Pont Aux Dames (FR); Olivier Perrin, Chatillon (FR); Sylvie Legastelois, Asnieres sur Seine (FR)

(73) Assignee: Chanel Parfums Beaute, Neuilly-sur-Seine (FR)

( * ) Notice: Subject to any disclaimer, the term of this patent is extended or adjusted under 35 U.S.C. 154(b) by 138 days.

(21) Appl. No.: 13/059,556

(22) PCT Filed: Aug. 18, 2009

(86) PCT No.: PCT/FR2009/051595

§ 371 (c)(1),
(2), (4) Date: Feb. 17, 2011

(87) PCT Pub. No.: WO2010/020731

PCT Pub. Date: Feb. 25, 2010

(65) Prior Publication Data

US 2011/0147399 A1 Jun. 23, 2011

(30) Foreign Application Priority Data

Aug. 20, 2008 (FR) ..... 08 55650

(51) Int. Cl.

| | |
|---|---|
| ***B65D 43/16*** | (2006.01) |
| ***B65D 43/26*** | (2006.01) |
| ***A45D 40/22*** | (2006.01) |
| ***A45C 13/00*** | (2006.01) |
| *B65D 43/22* | (2006.01) |

(52) U.S. Cl.

CPC ..... *A45D 40/22* (2013.01); *A45C 13/005* (2013.01); *A45D 40/221* (2013.01)

USPC ..... 220/830; 220/835; 220/264; 220/283

(58) Field of Classification Search

USPC ..... 220/810, 4.22, 264, 283, 835

See application file for complete search history.

(56) References Cited

U.S. PATENT DOCUMENTS

| | | | |
|---|---|---|---|
| 1,930,308 | A | 10/1933 | Devlin |
| 2,054,004 | A | 9/1936 | Sandberg |

(Continued)

FOREIGN PATENT DOCUMENTS

| | | |
|---|---|---|
| DE | 642947 | 12/1996 |
| FR | 2624359 | 12/1988 |

OTHER PUBLICATIONS

International Search Report; Publication No. 2008/102273 A3; published Dec. 24, 2008.

(Continued)

*Primary Examiner* — Mickey Yu
*Assistant Examiner* — Niki Eloshway
(74) *Attorney, Agent, or Firm* — Hunton & Williams LLP

(57) ABSTRACT

A case for a cosmetic or body hygiene product comprises a body having a bottom and a free edge 2B and containing a dish 5 containing a solid, pasty or pulverulent product, and a lid 3 mounted pivotably on the body. It also comprises movable equipment 11 comprising the dish and a hinge region 10 by which the lid is hinged thereto and which is able to undergo translational movement perpendicularly with respect to the bottom, and at least one elastically compressible assembly 40 having two stable withdrawn positions with respect to a maximum pushed-in position, said assembly being inserted between the body and the movable equipment so as to delimit for this equipment a maximum pushed-in configuration and a minimum pushed-in configuration, these configurations being such that, when the movable equipment is in the maximum pushed-in configuration and the lid is in the closed configuration, the hinge region of the equipment and at least part of this lid are retracted into the body whereas, when this equipment is in the minimum pushed-in position, the hinge region is at least partly outside the body so that the lid can pivot between its configurations and the lid has a sufficient handhold for a user to carry out this pivoting movement.

16 Claims, 5 Drawing Sheets

(56) References Cited

U.S. PATENT DOCUMENTS

| | | | | |
|---|---|---|---|---|
| 2,535,455 | A | 12/1950 | Reilly | |
| 4,483,355 | A * | 11/1984 | Yuhara | 132/301 |
| 5,908,037 | A * | 6/1999 | Pierson | 132/293 |
| 5,909,738 | A * | 6/1999 | Quennessen | 132/293 |
| 6,345,627 | B1 * | 2/2002 | Petit | 132/293 |
| 6,386,209 | B1 * | 5/2002 | Yuhara et al. | 132/294 |
| 7,467,727 | B2 * | 12/2008 | Yuhara | 220/4.22 |
| 7,963,420 | B2 * | 6/2011 | Yamanaka | 220/830 |
| 8,261,934 | B2 * | 9/2012 | Salciarini et al. | 220/835 |
| 2007/0090106 | A1 * | 4/2007 | Yuhara et al. | 220/4.22 |

OTHER PUBLICATIONS

International Search Report; Publication No. 2010/020731A3; published Mar. 4, 2010.

* cited by examiner

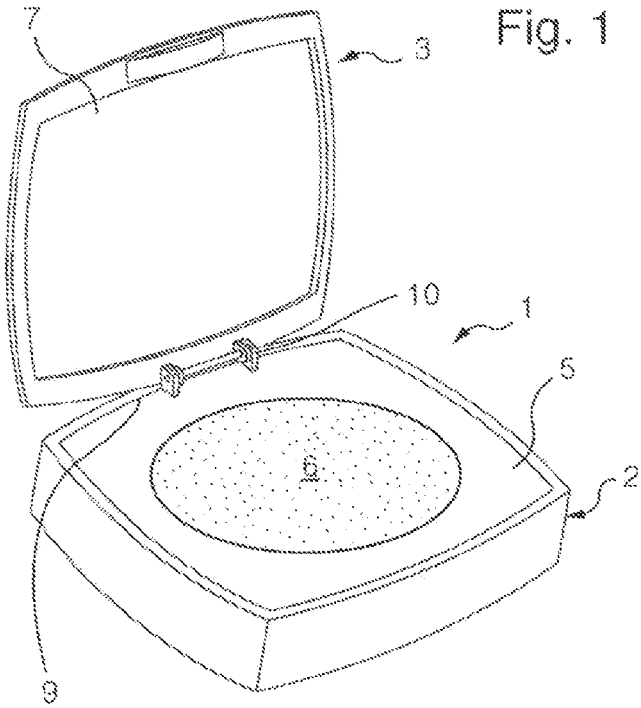
Fig. 1
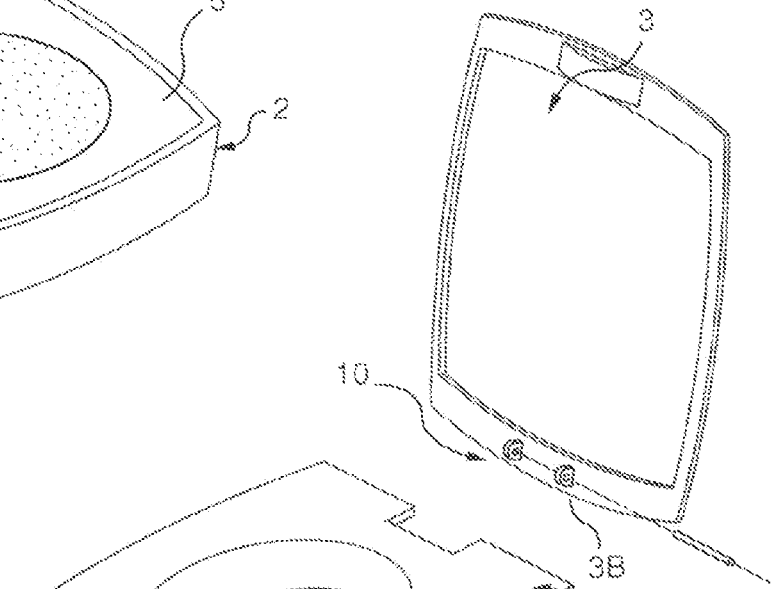
Fig. 2
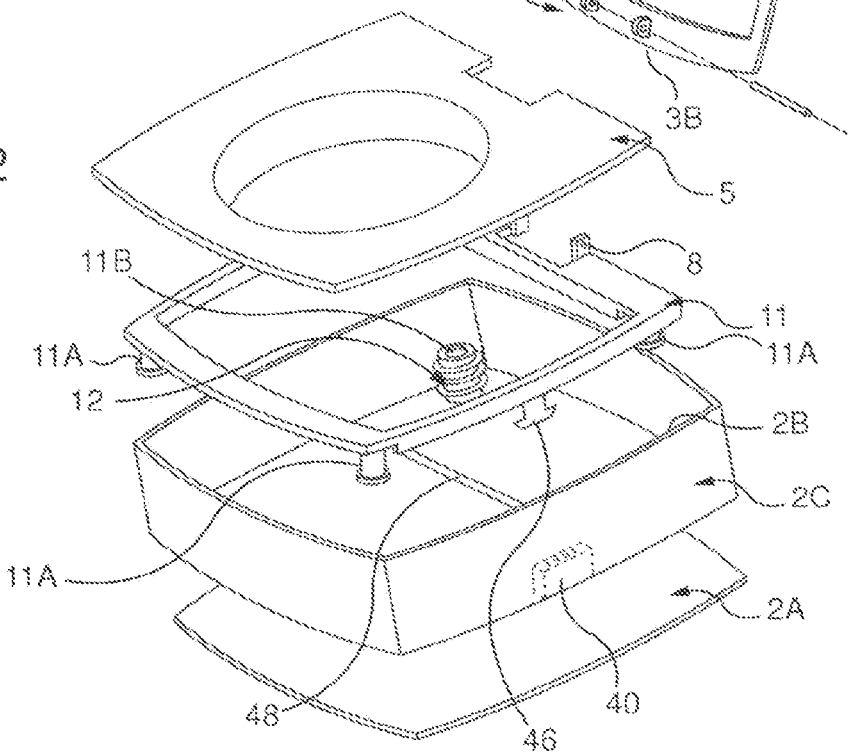

CASE FOR COSMETIC OR BODY HYGIENE PRODUCT HAVING A RETRACTABLE HINGE

CROSS-REFERENCE TO RELATED APPLICATIONS

This application is the U.S. National Phase of International Application No. PCT/FR2009/051595 filed on Aug. 18, 2009, which claims priority to French Application No. FR 0855650 filed Aug. 20, 2008, both of which are incorporated by reference herein in their entireties.

FIELD OF THE INVENTION

1. Prior Art

The invention concerns a case for a solid, paste or powder cosmetic or body hygiene product such as a powder or a cream in particular.

2. Background

Such a case is traditionally globally flat (with a height significantly less than its other dimensions), with a shape that may be round, square (possibly with rounded corners), rectangular, polygonal, etc. It is generally composed of a body, typically formed of a bottom and a lateral wall, and a lid articulated to the lateral wall and having a rim which, in the closed configuration of the case, lines up with this wall or even caps it. To provide for a large angular movement of the lid relative to the body, for example to enable the user to use the mirror that the interior face of the lid may include (this explains why this angular movement is typically greater than 90°, for example of the order of 120°), the articulation generally runs along the exterior surfaces of the lateral wall and the lid (usually its rim). It follows that this hinge is therefore visible, which can degrade the overall esthetics of the case.

Moreover, the lid of such a case is generally maneuvered by action on a projection on the lid at a distance from the articulation; this projection often cooperates with another projection provided on the lateral wall to retain or even lock the lid to the lateral wall in the closed configuration. These projections lie close to the interface between the lid and the body, for example.

Also known are containers for cosmetic or body hygiene products that include a body and a lid, as before, but in which this lid, instead of being articulated, is retained in the closed configuration by screwing it on or even by clipping it on. However, such a structure is hardly usable for flat shapes and so these containers are generally more bulky than the aforementioned cases (they are generally referred to as "pots"). Moreover, it has the drawback that the lid is therefore independent of the body, which obliges the user to put it down separately from the body if they wish to access the interior of the container; moreover, opening (and closing) the container entails using both hands, in complex movements that may be uncomfortable, especially if the user is not seated at a table or is in a public place. This explains the preference for cases in which the lid remains permanently connected to the body, for reasons of compactness, simplicity of use and reliability.

However, it has just been explained that cases for cosmetic or body hygiene products that include a lid connected permanently to the body of the case generally have one or more visible hinges and projections, which has the drawback of constituting at least visual discontinuities relative to the body and the lid, which may degrade the overall esthetic. Another drawback of such hinges or projections is that they can snag on adjacent objects, or even on the lining of a pocket or a handbag, and lead to unintentional opening of the case if this snagging is caused by the projections used to open or unlock the lid.

GENERAL DESCRIPTION OF THE INVENTION

There is therefore a requirement for a case for cosmetic or body hygiene products including a lid permanently connected to a case body that is compact, simple and reliable to use, with the fewest possible projections and, in particular, invisible hinges.

Thus the invention provides a case for cosmetic or body hygiene products including an articulated lid the articulation of which is not visible from the exterior in the closed configuration which, without impeding pivoting and without exaggerated clearance between the edge of the lid and the free edge of the case body, enables a large relative pivoting movement of the lid from a configuration retracted into the body of the case.

It should be noted here that the simple inward movement of the conventional articulation of cases with a case body does not make it possible to achieve this objective. The articulation would in this case be disposed under the lid and within the volume of the case body, so that at the beginning of pivoting of the lid its rear part (close to the articulation axis) would start by moving back toward the free edge, which would cause jamming; to prevent such jamming, it would be necessary to provide a significant clearance between the free edge of the lid and the free edge of the body, but this would degrade both the esthetic of the case and the protection of its content from the exterior environment (and vice-versa).

The invention proposes a case for a solid, paste or powder cosmetic or body hygiene product including a body having a bottom and a free edge and containing a dish containing a solid, paste or powder product and a lid mounted on the body to pivot relative to the body between a configuration in which access to the product is possible and a closed configuration, characterized in that it also includes a mobile assembly including the dish and an articulation area by which the lid is articulated thereto and which is able to move in translation perpendicularly to the bottom, and at least one elastically-compressible assembly having two stable retracted positions relative to a maximum pushed-in position, which assembly is inserted between the body and the mobile assembly so as to delimit a maximum pushed-in configuration and a minimum pushed-in configuration of this assembly, these configurations being such that, when the mobile assembly is in the maximum pushed-in configuration and the lid is in the closed configuration, the articulation area of the assembly and at least part of this lid are retracted into the body whereas, when this assembly is in the minimum pushed-in configuration, the articulation area is at least partly outside the body so that the lid can pivot between its configurations and the lid offers sufficient grip for a user to bring about this pivoting movement.

Given that the lid is articulated to an assembly mobile relative to the bottom of the body it is clear that when the lid is in the closed configuration it forms conjointly with the mobile assembly, without a large clearance, an assembly that may be sufficiently retracted into the body to conceal the articulation and to minimize the possibility of the lid snagging on something in its environment to the point of opening unintentionally; furthermore, the esthetic of the case is very clean as the lid has no portion projecting relative to the body and no projecting articulation or opening/closing projection.

To the contrary, the fact that this assembly also has a stable configuration in which the articulation and the lid are at least partially deployed from the body makes it possible to command pivoting of the lid by the user placing one finger or just one fingernail on the lid, as well as pivoting over a significant amplitude, making it possible to use a mirror, if any, placed on the internal face of the lid.

The use of the elastically-compressible assembly makes it possible to guarantee that, by pressing on the lid (and thus on the mobile assembly when the lid is in the closed configuration), as a consequence of the bistable nature of this assembly, the assembly reaches the configuration enabling pivoting.

Nevertheless, the structure of the case is compatible with great compactness, including in the direction of its thickness, whilst being very user friendly and very easy to use (in particular the content of the product is efficaciously protected from the exterior environment, and vice-versa).

According to one particularly advantageous feature of the invention, the minimum pushed-in configuration of the mobile assembly is such that the dish is flush with the free edge of the body. This has the advantage that, in the open configuration of use, the case assumes the usual appearance of a dish occupying substantially all of the volume of the body, while at the same time, on closing the lid, this dish retracts toward the bottom to enable retraction of the lid.

Equally advantageously, the mobile assembly and the body include complementary elements defining translation guide feet; this has the particular advantage that the movement in translation of the mobile assembly relative to the case body may be achieved reliably even if the user does not press on the center of the lid to actuate the elastically-compressible assembly.

Said feet are preferably designed to prevent the mobile assembly separating from the body beyond the minimum pushed-in configuration; this has the particular advantage of preventing unwanted extraction of the assembly from the body of the case.

The feet are preferably at a distance from the components of the elastically-compressible assembly; this has the particular advantage of dissociating the guiding function and the function of delimiting the pushed-in configurations of the mobile assembly.

These feet advantageously include elastically-compressible elements tending to move the mobile assembly away from the bottom of the body; of course, these elastically-compressible elements must not suffice in themselves to bring the mobile assembly into its minim pushed-in configuration, with the elastically-compressible assembly in its deepest stable position in the case body; this spring-loading may have the advantage of facilitating outward translation movement of the mobile assembly when the elastically-compressible assembly is actuated to raise this assembly, even if this assembly is located eccentrically relative to the case body.

According to another advantageous feature, complementary attachment means are provided between the assembly formed of the lid and the mobile assembly and the case body to enable temporary retention of the lid in its closed configuration; this has the particular advantage of minimizing unwanted escape of the lid from the case body, in particular following a violent impact.

These complementary means are preferably carried by the lid and a plunger of the elastically-compressible assembly; this has the particular advantage of making it possible for the change of configuration to command attachment and detachment of this lid to/from the case body.

According to another advantageous feature, the mobile assembly includes a mobile frame including the articulation area and cooperating with the elastically-compressible assembly and in which the dish is reversibly engaged; this has the particular advantage that the dish may be replaced without having to modify the rest of the mobile assembly; moreover, this frame advantageously occupies the whole of the internal section of the case body, which contributes to facilitating guidance of the overall movement, as well as imparting some rigidity to the mobile assembly.

According to another advantageous feature, the elastically-compressible assembly includes at least one plunger which has two bearing surfaces mobile relative to each other and spring-loaded toward each other by at least one spring, one bearing surface being attached to a closed heart-shaped guide track globally situated in a plane perpendicular to the mean plane of the bottom and the other bearing surface having a follower linger adapted to follow this guide track during relative movements of this bearing surface.

In a variant of equal benefit, the elastically-compressible assembly includes at least one plunger that has two bearing surfaces formed of two rings mobile relative to each other in rotation and in translation and pressed one toward the other by at least one spring, one ring including radial projections pressed against an annular track attached to the other ring, this annular track being sawtooth-shaped with the teeth having at least two different depths.

Of course, other configurations are possible.

The idea of the plunger is that the mobile assembly merely bears on the plunger, so that it is not retained in the direction of separation. Alternatively, it is possible for the hearing surface that is not attached to the case body to be attached to the mobile assembly, which establishes a coupling in both directions of translation movement between the mobile assembly and the case body.

According to a further advantageous feature, the elastically-compressible assembly includes at least two elastically-compressible plungers with two stable retracted positions relative to a maximum pushed-in position disposed on respective opposite sides of a section plane of the case passing through the articulation area; this has the particular advantage of distributing the areas in which the elastically-compressible assembly acts on the mobile assembly. The elastically-compressible assembly advantageously includes at least two elastically-compressible plungers that include synchronization elements.

It is equally advantageous if the body has the overall shape of a rectangle or a square (or even a polygon with an even number of sides); in this case, there may be only one articulation area and the elastically-compressible assembly may include only one plunger, this area and this plunger being disposed substantially in the middle of two opposite sides, which yields a compact and elegant shape and facilitates movement. In one variant (among others), this body may also have any shape, in particular a circular or oval shape having a plane of symmetry, there being only one articulation and only one plunger, both situated on this plane of symmetry.

LIST OF FIGURES

Objects, features and advantages of the invention emerge from the following description, given by way of nonlimiting and illustrative example with reference to the appended drawings, in which:

FIG. 1 is a perspective view of a case of the invention,

FIG. 2 is an exploded perspective view of it,

Figure 4:
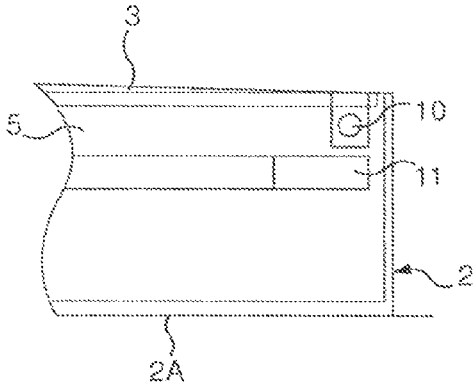
Figure 5:
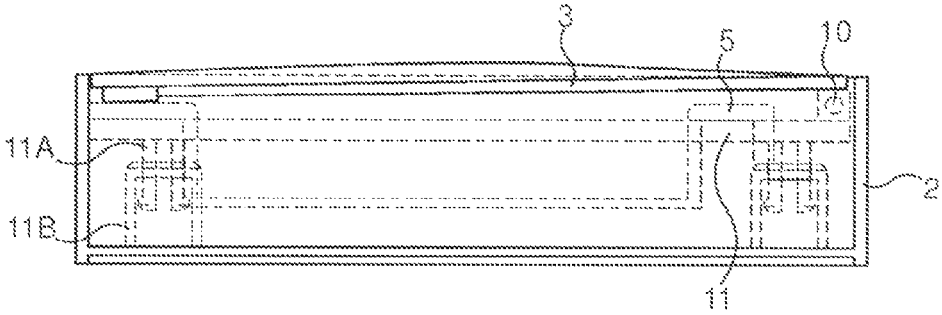
Figure 6:
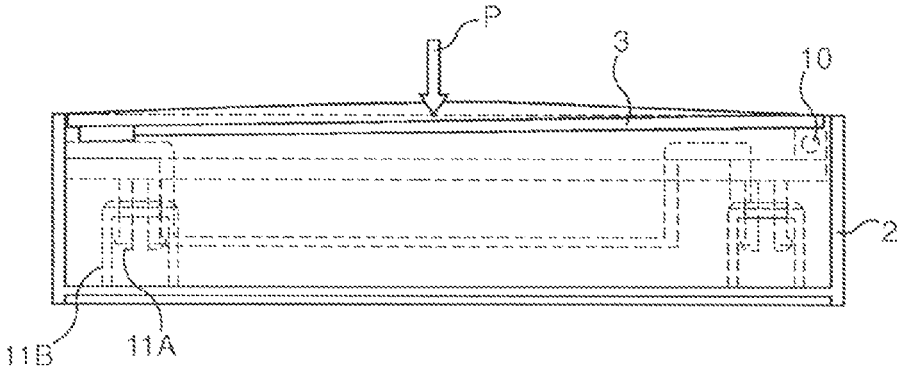
Figure 7:
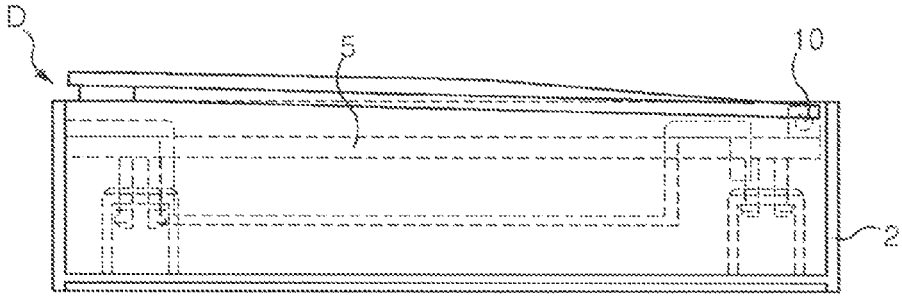
Figure 8:
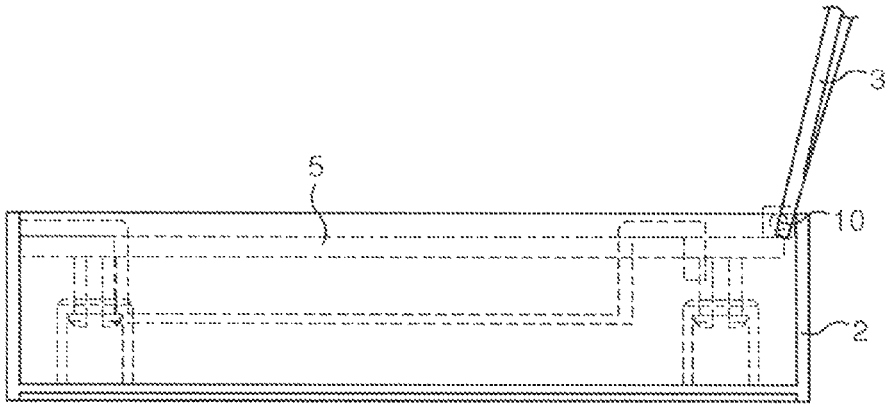
Figure 11:
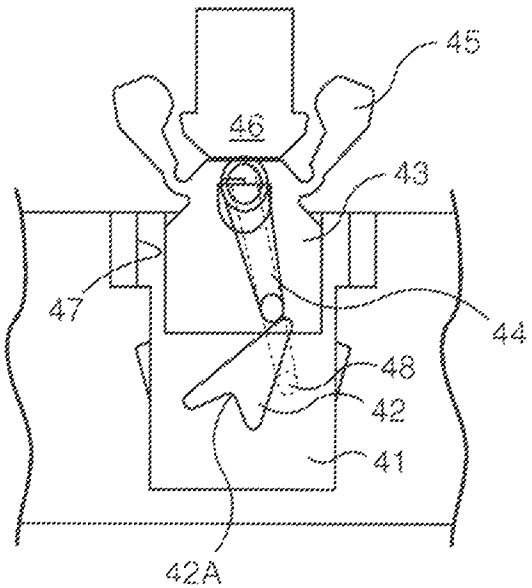
Figure 10:
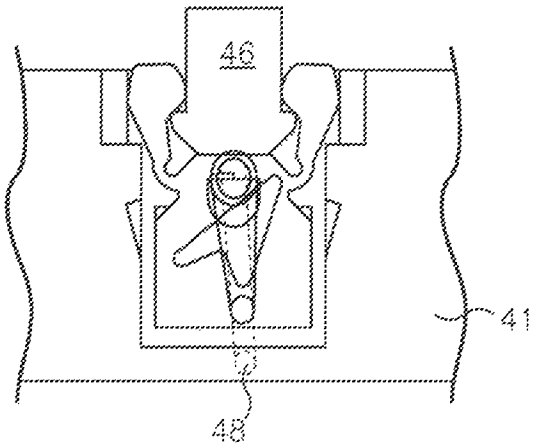
Figure 9:
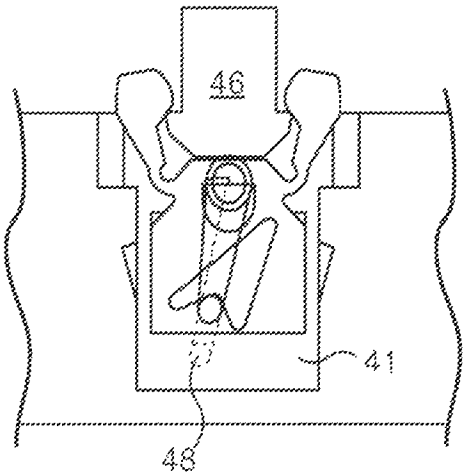
Figure 14:
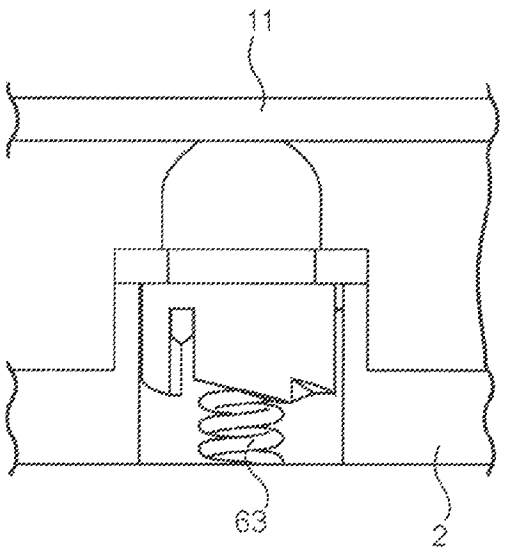
Figure 13:
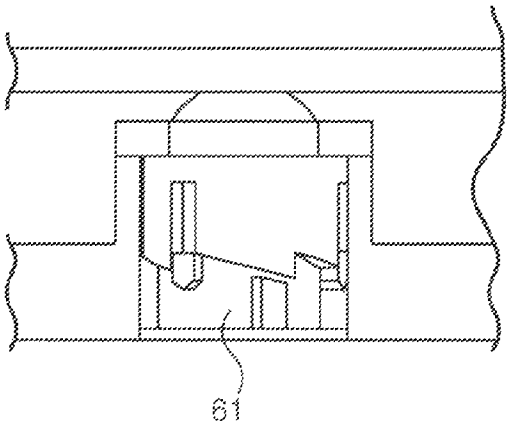
Figure 12:
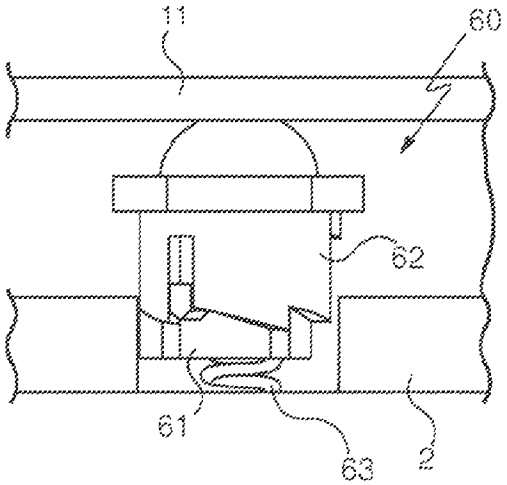

FIG. 4 is a sectional view of an articulation between a lid and a mobile assembly contained in the body of the case, FIG. 5 is a sectional view of the case in the closed configuration, FIG. 6 is a similar view of it after depressing an action area of the lid over a limited travel, FIG. 7 is a similar view of it after deployment of the lid from the case, FIG. 8 is a similar view of it in the open configuration, FIG. 9 is a sectional diagram of a different embodiment of the plunger including attachment elements in a configuration corresponding to FIG. 5, FIG. 10 is a view of it corresponding to FIG. 6, FIG. 11 a view of it corresponding to FIG. 7, FIG. 12 is a detail showing another example of a bistable push-in plunger of the lid in the closed configuration, corresponding to FIG. 5, FIG. 13 is a view of it corresponding to FIG. 6, and FIG. 14 is a view of it corresponding to FIG. 7.

DETAILED DESCRIPTION OF THE INVENTION

FIG. 1 represents diagrammatically a case for a (solid, paste or powder) cosmetic or body hygiene product conforming to the invention and FIG. 2 is an exploded view of it (minus the maneuvering elements).

This case, designated as a whole by the reference 1, includes a body 2 having a bottom 2A and a free edge 2B, together with a lid 3 mounted to pivot between a configuration in which access to the product is possible (this is the case in FIG. 1) and a closed configuration in which the lid obstructs access to the interior of the case. The lid is thus connected permanently to the body (although indirectly, as will be explained hereinafter).

In this body is disposed a dish 5, usually referred to as the "sifter", containing the product in question, here designated by the reference 6, sometimes referred to as a "cake" when it is solid. This product may be a powder, also a make-up element, etc.

In the example represented, the free edge 2B is defined by the upper edge of a lateral wall 2C connected by its lower edge to the bottom 2A. Moreover, this body has a globally rectangular shape, to be more precise a substantially square shape, with curved sides.

To be more precise, as is clear from FIG. 2, in the example represented the bottom 2A is an element attached to a lateral wall; thus, if required, the bottom and this lateral wall can be in two different materials and have different, even contrasting appearances. In a variant that is not shown the body is in one piece.

In FIG. 1, the lid has on its internal surface a mirror 7 that can assist a user to apply the product 6 to their face.

In contrast to a conventional assembly, in which the lid would be articulated directly to the case body, the lid 3 is articulated, in an area 9, to a mobile assembly that includes the dish and is mobile in translation perpendicularly to the bottom; the case is furthermore provided with an elastically-compressible assembly with two stable retracted positions relative to a maximum pushed-in position, which is disposed between the body and the mobile assembly so as to delimit for that assembly a maximum pushed-in configuration and a minimum pushed-in configuration, these configurations being such that, when the mobile assembly is in the maximum pushed-in configuration and the lid is in the closed configuration, the area of articulation of the assembly and at least part of the lid are retracted into the body whereas, when this assembly is in the minimum pushed-in configuration, the articulation area is at least partly outside the body to allow the lid to pivot between its configurations and to offer the user sufficient grip to bring about this pivoting. These various configurations are commented on hereinafter.

The mobile assembly includes primarily a frame 11 and in the example represented the lid 3 is articulated to this frame by means of a hinge designated by the general reference 10; this hinge is of any appropriate known type. In the example considered here, it is simply formed by an articulation pin that passes, on the one hand, through lugs 3B attached to the lid and, on the other hand, through lugs 8 attached to the frame. Alternatively, this articulation may consist of two rivets each passing through a lug 3B of the lid and a lug 8 of the frame; other known types of articulation and/or hinge are possible, of course.

This simple hinge is situated substantially in the middle of one side of the case body, given that this body has a polygonal section.

The dish or sifter 5 is advantageously a removable part engaged in the frame 11 and here this frame is itself preferably mounted on at least one elastic member, here on springs (one of which is shown under the reference 12) that urge it toward the exterior of the body. This frame advantageously includes feet 11A which define a maximum pushed-in position of this frame by moving against the action of the springs into abutting engagement against the bottom. This dish is advantageously connected reversibly to this frame to enable it to remain attached in use while it can be detached temporarily if required (for example for maintenance or to replace the product). This reversible fixing is produced for example by clipping together complementary elements (not represented) on this dish and on this frame. In a variant that is not represented, the dish is permanently attached to its frame or forms with the frame a single part constituting the mobile assembly.

In the example represented, in the open configuration of the case (see FIG. 3) the frame 11 is preferably retracted (i.e. lower) relative to the free edge 2B of the body, which makes it possible for the dish 5, once engaged in the frame 11, to be flush with the free edge 2B. This frame (together with the dish) may furthermore retract toward the bottom of the case body to make it possible, in the closed configuration, for the lid to be flush with this free edge, thus being sufficiently retracted into this body to prevent unwanted snagging of the lid on an exterior element to the point of forcibly opening the lid.

The dish is mobile between a pushed-in configuration (see FIG. 4) in which it is retracted relative to the free edge of the body and a use configuration in which it is advantageously flush with this free edge.

The elastically-compressible assembly with two stable retracted configurations relative to a maximum pushed-in position in practice includes at least one plunger such as that represented under the reference 40 in FIG. 2 and that is described in more detail with reference to FIGS. 9 to 11.

The frame is advantageously retained within the body (without leaving it) with a small clearance relative to the lateral wall 2C of the body. This retention is advantageously achieved by loose clipping interengagement between complementary studs provided on the underside of the frame and the bottom of the body (the studs may include the feet 11A with which the frame is provided and cylindrical tubes 118 attached to the bottom and here surrounded by the springs).

Figure 3:
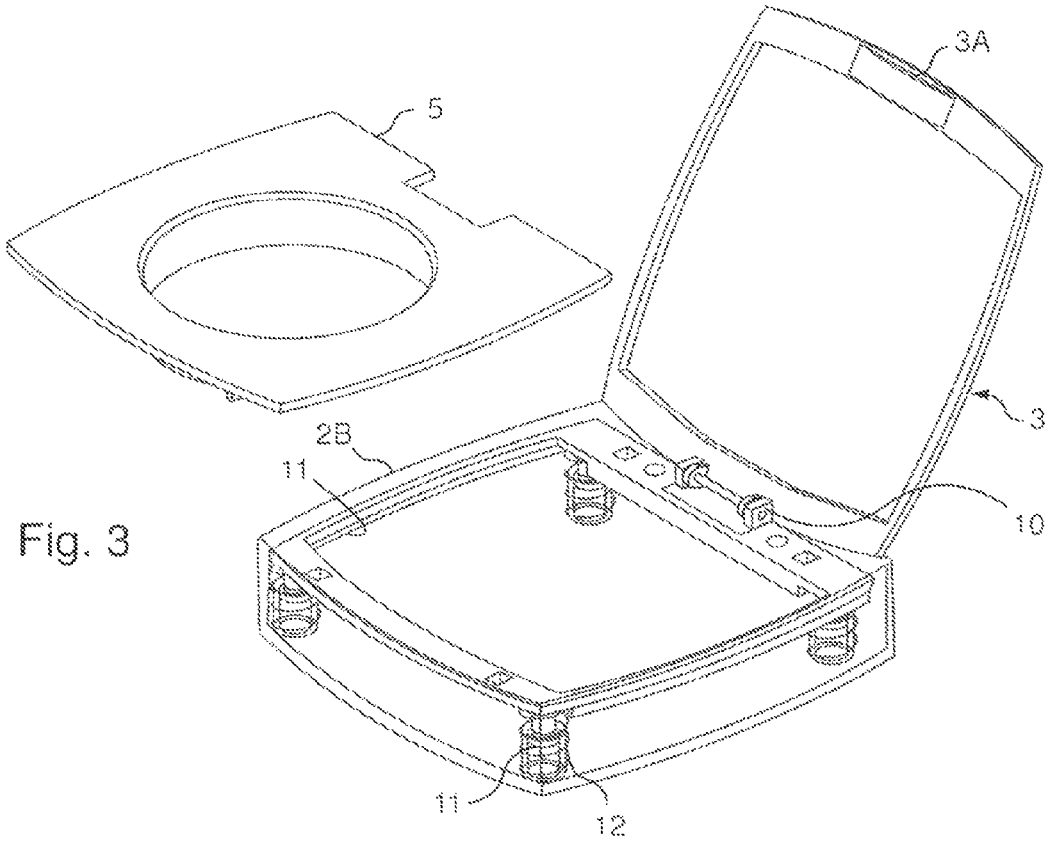
FIG. 3 is a perspective view of it.

It emerges clearly from FIG. 3 that in the example considered here the frame is subjected to the thrust of at least two identical springs distributed in a substantially symmetrical manner relative to a plane of symmetry (a vertical plane intersecting the articulation area 9, for example the plane of FIG. 4).

Instead of a single articulation area 9, the lid may be articulated in a plurality of areas, for example two articulation areas disposed symmetrically with respect to a plane of symmetry, if any, of the case.

The articulation area 9 is shorter than the side of the body near which it is situated (for example not more than half the length of such a side, typically between one-quarter and one-half thereof). To ensure precise pivoting without twisting it suffices for a hinge to extend over about a quarter of the length of this side (or even less).

The frame is advantageously subjected to the thrust of a plurality of springs (here a spring in each corner of the body), which optimizes guidances as well as minimizing the risk of buckling of the frame and thus of jamming of the mobile assembly. Alternatively, there may be a different, notably smaller, number of springs.

These elastic elements are in practice sufficient to raise the frame and its dish into the open configuration of the case without impeding the retention of the mobile assembly (and the lid) in their maximum pushed-in configurations.

The lateral wail is advantageously parallel at all points to the direction of movement of the plunger (i.e. upward), which means that the internal volume delimited by this wall is of constant horizontal section.

FIGS. 5 to 8 represent four phases in the opening of a case such as that which has just been described.

In FIG. 5, the lid is flush with the free edge of the body of the case and the bistable assembly (i.e. the elastically-compressible assembly with two stable positions) is in a retracted configuration (FIG. 9). In this position, the articulation axis is below the level of the upper free edge of the lateral wall of the case body.

When a user wishes to obtain access to the product, they apply to the lid, and thus to the mobile assembly, anywhere (preferably substantially at the center) a thrust P toward the bottom of the body (FIG. 6). As a result of this the bistable assembly (and thus the plunger 40) is moved to or near its maximum pushed-in configuration (FIG. 10); this is an unstable maximum pushed-in configuration, as is reflected in the plunger moving of its own accord into its relaxed configuration (FIG. 11) when the pressure on the lid is removed; it follows from this that the mobile assembly and the lid move slightly upward (see FIG. 7), but this is sufficient to offer sufficient grip (denoted D in FIG. 7) for the user to move the lid into an open configuration that suits them (FIG. 8), using only one finger or only one fingernail, benefiting from the fact that the articulation 10, which has followed the movement of the combination of the assembly and the lid, has risen sufficiently above the free edge of the lateral wall of the case body to allow pivoting through a large angle, typically greater than 90°, even reaching or exceeding 120°, for example.

In a variant that is not represented, a spring is associated with the hinge to apply a torque to the lid so that it moves of its own accord to its maximum open configuration (without this torque being sufficient to prevent the lid from remaining in its closed configuration when required). In another variant, an elastically deformable member may also be provided to contribute to holding the lid in the other of its extreme angular positions, namely in the closed configuration; for example protruberances may run along the inside of the free edge to provide slight retention of the lid when it is in the closed configuration. Retaining the lid in one and/or the other of its extreme configurations may also be assisted by means of a hard spot produced by deformation of the hinge pin cooperating with a leaf spring, a magnet or any other appropriate element.

To close the lid without exerting on it any force aiming to cause it to depart from its retracted configuration, the user folds it down and presses it hard enough to push the plunger in as far as or near its maximum pushed-in configuration, so that it comes into its retracted configuration in which the lid is flush with the free edge; the existence of a force tending to raise the mobile assembly above its minimum pushed-in configuration is acceptable if there are detents between the studs 11A and 11B mentioned above, constituting abutments defining the high position of the mobile assembly; these detents can advantageously be unclipped.

It is clear that the fact that the lid offers no grip for accidental opening when it is in the closed configuration does not imply that the lid as a whole is retracted into the volume of the case, especially when it is domed as in the case considered here. It is even sufficient for only part of the thickness of the free edge of the lid to be retracted into the volume of the case body.

The bistable assembly includes at least one bistable plunger (there are preferably two identical plungers disposed at a significant distance from each other).

As represented diagrammatically in FIGS. 9 to 11, the plunger denoted 40 includes two parts mobile relative to each other and spring-loaded relative to each other by at least one spring. One of these parts, the part 41, is attached to a closed heart-shaped guide track (here surrounding an arrowhead-shaped projecting portion 42) that is globally situated in a plane perpendicular to the mean plane of the bottom, i.e. vertical. The other part 43 includes an arm 44 having a follower finger adapted to follow this guide track during relative movement between these bearing surfaces. These parts have a rotational relative movement or the follower finger has a pivoting relative movement (the situation shown). When the follower finger is retained in the notch 42A of the path (i.e. in its lower part), the plunger is retracted whereas when the follower finger is in the higher part of the path the plunger is in the deployed configuration.

Here the part 41 is attached to the case body while the part 43 is a mobile part on which the mobile assembly bears to change the configuration.

The consequence of the fact that the plunger 41 includes a track globally situated in a vertical plane is that this plunger may have a flattened section, which makes it possible to locate it along a portion of the lateral wall 2C of the case body.

It may be noted that in FIGS. 9 to 11 the arm 44 extends beyond the follower finger as far as an end denoted 48. Such an extension (which is rectilinear here but could alternatively be bent) makes possible a connection between the follower fingers of a plurality of plungers, for example by means of a link 48 in FIG. 2. This enables synchronization of various plungers forming part of the bistable assembly.

At least one of the plungers is advantageously adapted to interengage in the maximum pushed-in configuration with complementary attachment elements provided on the mobile assembly (or even on the lid, via the mobile assembly); this makes it possible to ensure firm retention of the lid in the closed position, independently of the force of the springs 12; this makes it possible to ensure accurate guidance of the mobile assembly even if there is only one plunger eccentrically positioned relative to the case as a whole.

To be more precise, the mobile part 43 of the plunger here includes claws 45 globally oriented toward the lid and mounted to slide with this part 43 perpendicularly to the bottom between an upper configuration in which the claws are spaced apart and a lower configuration in which the claws are held close together. Moreover, the mobile assembly or the lid includes a protruberance 46 (see FIG. 2) adapted to be engaged between the claws with the lid in the closed configuration.

In the example represented, the attachment claws are attached to the mobile part of the plunger, i.e. the plunger is of an integral attachment or locking) type. It is clear, however, that in a variant the plunger and locking functions may be dissociated in separate elements.

The mobile part to which the claws are attached advantageously includes an abutment, here a central abutment, against which the protruberance bears to cause penetration of the claws between ramps 47 adapted to force the claws toward each other.

FIGS. 12 to 14 represent a variant of a plunger forming part of the bistable assembly. This plunger 60 is of a type including two bearing surfaces formed of two rings 61 and 62 mobile relative to each other in rotation and in translation and pressed together by at least one spring 63. One ring 61, which is mobile relative to the bottom, includes radial projections pressed axially against, an annular track attached to the other ring 62, which is attached to the bottom, this track oriented toward the bottom being of sawtooth shape with (upward-facing) teeth that have one or the other of two different heights. Clearly, depending on whether the radial projections are facing shallow teeth or deep teeth, the plunger assumes one or the other of two configurations, depending on whether the mobile ring 61 has been able to rise inside the fixed ring 62 or not.

This type of plunger is somewhat similar in principle to the push-button on a ball-point pen.

This type of plunger seems more suitable than the plunger 40 at a distance from the lateral wall of the case body. However, the plunger 40 seems preferable, in that it is easier to accommodate inside a case.

A (passive) coupling may be employed between opening of the lid and lowering of the mobile assembly so that opening the lid is possible only when the mobile assembly is in the high position and, conversely, lowering the mobile assembly is possible only when the lid is folded against the mobile assembly. For example, a wedge may be provided on the lateral wall of the body 2, near the hinge, to cooperate with a finger attached to the lid.

Of course the cases of the invention may have many other shapes, notably polygonal, or even round or oval.

Moreover, the components of these cases may be different from those explicitly described hereinabove. Thus in particular the spiral springs 12 may be replaced by leaf springs or any other type of spring member.

By way of nonlimiting and illustrative example:

the body of the case is in ABS type plastic material, covered with a protective varnish, with a length of 70 mm and a width of 70 mm (its section is thus substantially square) and a depth of 15 mm, the bottom having a thickness of 2 mm and its wall a thickness of 1.5 mm, the studs 11 having a diameter of 6 mm, the plunger has a push-in travel of 1.2 mm relative to its retracted configuration and an expansion travel of 2.2 mm between the extended configuration and this retracted configuration, the dish is in a PP type plastic material and has a thickness of 1.5 mm, the lid is in an appropriate plastic material, advantageously varnished, preferably with a mirror on its internal face (alternatively it is in a plastic material provided with an aluminum alloy, anodized aluminum alloy or ferrous alloy embellisher, the mirror and the lid possibly being formed of the same material) and has a thickness of 1.5 mm.

The invention claimed is:

1. A case for a solid, paste or powder cosmetic or body hygiene product comprising:

a body comprising a bottom and a free edge a dish containing a solid, paste or powder product, and a lid mounted on the body and pivotable relative to the body between a product-accessible configuration and a closed configuration, said case further comprising:

a mobile assembly comprising the dish and an articulation area consisting essentially of a hinge connecting the lid to the mobile assembly and about which the lid is adapted to pivot with respect to the mobile assembly, said hinge defining an articulation axis fixed with respect to this mobile assembly, said lid being mounted to the body through this mobile assembly, wherein said mobile assembly is adapted to move essentially in translation perpendicularly to the bottom, and at least one elastically-compressible assembly designed so as to have two stable retracted positions relative to a maximum pushed-in position, wherein said elastically-compressible assembly is positioned between the body and the mobile assembly and delimits for the mobile assembly, a maximum pushed-in configuration when this elastically-compressible assembly is in one of its two stable retracted positions and a minimum pushed-in configuration when this elastically-compressible assembly is in its other one of its two stable retracted positions, and further wherein:

when the mobile assembly is in the maximum pushed-in configuration and the lid is in the closed configuration, the articulation area of the mobile assembly and at least part of the lid are retracted into the body, and when the mobile assembly is in the minimum pushed-in configuration, the articulation area is at least partially outside the body, and the lid provides sufficient grip for a user to pivot the lid between the product-accessible configuration and the closed configuration.

2. The case of claim 1, wherein when the mobile assembly is in the minimum pushed-in configuration, the dish is flush with the free edge of the body.

3. The case of claim 1, wherein the mobile assembly and the body comprise elements defining translation guide feet extending perpendicularly to the bottom of the body.

4. The case of claim 3, wherein said translation guide feet are adapted to prevent the mobile assembly from separating from the body beyond the minimum pushed-in configuration.

5. The case of claim 3, wherein the translation guide feet are located at a distance from said at least one elastically-compressible assembly.

6. The case of claim 3, wherein said translation guide feet comprise elastically-compressible elements permanently tending to move the mobile assembly away from the bottom of the body.

7. The case of claim 1, further comprising complementary attachment means between an assembly comprising the lid and the mobile assembly, and the case body for temporary retention of the lid in the closed configuration.

8. The case of claim 7, wherein the complementary attachment means are carried by the lid and a plunger of the elastically-compressible assembly.

9. The case of claim 1, wherein:

the mobile assembly comprises a mobile frame comprising the articulation area, said mobile frame cooperates with the elastically-compressible assembly, and the dish is reversibly engaged in the mobile frame.

10. The case of claim 1, wherein the elastically-compressible assembly comprises at least one plunger comprising first and second bearing surfaces which are mobile relative to each other and spring-loaded toward each other by at least one spring, wherein:

the first bearing surface is attached to a closed heart-shaped guide track located in a plane perpendicular to a mean plane of the bottom, and the second bearing surface comprises a follower finger adapted to follow the guide track upon movement of the second bearing surface.

11. The case of claim 1, wherein the elastically-compressible assembly includes at least one plunger comprising two bearing surfaces formed from two rings that are mobile relative to each other in rotation and in translation and which are pressed one toward the other by at least one spring, wherein a first ring comprises radial projections pressed against an annular track attached to a second ring, further wherein the annular track is sawtooth-shaped and comprises teeth having at least two different depths.

12. The case of claim 1, wherein the elastically-compressible assembly includes at least two elastically-compressible plungers comprising two stable retracted positions relative to the maximum pushed-in configuration, wherein said at least two elastically-compressible plungers are disposed on respective opposite sides of a section plane of the case that passes through the articulation area.

13. The case of claim 1, wherein the elastically-compressible assembly comprises at least two elastically-compressible plungers comprising synchronization elements.

14. A case comprising:

a body comprising walls and a bottom, a dish containing a solid, paste, or powder product, a lid mounted to an articulation area, and a mobile assembly comprising the dish and the articulation area, this articulation area consisting essentially of a hinge connecting the lid to the mobile assembly and defining an articulation axis fixed with respect to this mobile assembly, the lid being mounted to the body through this mobile assembly, wherein:

said mobile assembly is essentially movable in a direction perpendicular to the bottom between a pushed-in position and a released position, the bottom, walls, and lid define a body volume when the mobile assembly is in the pushed-in position, the articulation area is retracted into the body volume when the mobile assembly is in the pushed-in position, and the articulation area is located at least partially outside said body volume when the mobile assembly is in the released position.

15. A case for a solid, paste or powder cosmetic or body hygiene product comprising:

a body comprising a bottom and a free edge, a mobile assembly movable in the body essentially perpendicularly to the bottom of the body, said mobile assembly comprising a dish containing a solid, paste or powder product a lid hinged to the mobile assembly, at least one elastically-compressible assembly extending between the mobile assembly and the bottom of the body perpendicularly to said bottom and designed so as to have two stable retracted positions relative to a maximum retracted position, one of these retracted positions being less retracted than the other, this elastically-compressible assembly determining for the movable assembly a stable service configuration when this elastically-compressible assembly is in its less retracted stable position and a stable hidden configuration when this elastically-compressible assembly is in its most retracted stable position, whereby the lid is pivotable with respect to the body between a closed configuration where the mobile assembly is in its stable hidden configuration below the lid and a product-accessible configuration where the mobile assembly is in its stable service configuration.

16. The case of claim 15, wherein the lid is flush with the free edge when the lid is in its closed configuration and the mobile assembly is flush with this free edge when the lid is in its product-accessible configuration.

* * * * *